US012285646B2

(12) United States Patent
Huang

(10) Patent No.: US 12,285,646 B2
(45) Date of Patent: Apr. 29, 2025

(54) ADJUSTABLE DUMBBELL

(71) Applicant: Limin Huang, Yongkang (CN)

(72) Inventor: Limin Huang, Yongkang (CN)

( * ) Notice: Subject to any disclaimer, the term of this patent is extended or adjusted under 35 U.S.C. 154(b) by 100 days.

(21) Appl. No.: 18/093,982

(22) Filed: Jan. 6, 2023

(65) Prior Publication Data

US 2023/0264066 A1 Aug. 24, 2023

(30) Foreign Application Priority Data

Feb. 18, 2022 (CN) ..... 202220330436.7

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/072–075
See application file for complete search history.

(56) References Cited

U.S. PATENT DOCUMENTS 7,578,772 B2 * 8/2009 Lippitt ..... A63B 21/075 482/106
10,518,123 B2 * 12/2019 Moran ..... A63B 21/0726
2004/0005968 A1 * 1/2004 Crawford ..... A63B 21/0607 482/106
2012/0115689 A1 * 5/2012 Dalebout ..... A63B 21/0728 482/107
2018/0264308 A1 * 9/2018 Wang ..... A63B 21/075
2020/0398100 A1 * 12/2020 Wang ..... A63B 21/0726
2022/0047908 A1 * 2/2022 Weng ..... A63B 21/0728
2022/0347512 A1 * 11/2022 Hong ..... A63B 21/0728
2023/0173327 A1 * 6/2023 Wang ..... A63B 21/0724 482/107
2023/0271050 A1 * 8/2023 Tong ..... A63B 21/0728 482/108

* cited by examiner

*Primary Examiner* — Nyca T Nguyen
(74) *Attorney, Agent, or Firm* — Birchwood IP

(57) ABSTRACT

An adjustable dumbbell, comprising a dumbbell assembly, a dumbbell seat and dumbbell pieces, the dumbbell assembly comprises a dumbbell bar and connecting discs, which are provided with a positioning groove and a connecting block slidingly connected in the positioning groove, and the connecting disc is provided with an elastic component; the dumbbell assembly comprises a handle grip and gear blocks, and the glove and the gear block are fixed circumferentially, and the gear block has an outwardly pushing part and an inwardly shrinking part in the circumferential direction; the dumbbell piece is provided with a connecting groove, when the connecting block abuts against the shrinking part, the connecting block is separated from the connecting groove; the connecting block abuts against the pushing part, the connecting block is snapped into the connecting groove; when the connecting block abuts against the shrinking part, the connecting block is separated from the connecting groove.

9 Claims, 7 Drawing Sheets

ADJUSTABLE DUMBBELL

CROSS-REFERENCE TO RELATED APPLICATIONS

This application claims the benefit and priority of Chinese patent application No. 202220330436.7, filed on Feb. 18, 2022, disclosure of which is hereby incorporated by reference in its entirety.

TECHNICAL FIELD

The present application relates to the field of fitness equipment, in particular to an adjustable dumbbell.

BACKGROUND

Dumbbells are a simple piece of equipment used to strengthen muscles. The dumbbells on the existing market can be divided into weight-fixed and weight-adjustable. The more conventional adjustment method for weight-adjustable dumbbells is to install the dumbbell pieces on the dumbbell bar according to the weight requirements, and then lock the dumbbell pieces with compression nuts. This adjustment method needs to be realized by continuously disassembling and assembling the dumbbell pieces artificially, and the operation is relatively cumbersome.

So how to design a dumbbell that can conveniently take different numbers of dumbbell pieces has become a technical problem to be solved by designers.

SUMMARY

In order to solve the above problems, the present application proposes an adjustable dumbbell, which solves the problem of cumbersome operation of taking different numbers of dumbbell pieces.

The technical solution proposed by the present application is: An adjustable dumbbell, comprising a dumbbell assembly, a dumbbell seat and a plurality of dumbbell pieces for placing on the dumbbell seat, wherein the dumbbell assembly comprises a dumbbell bar and a plurality of connecting discs circumferentially fixed with the dumbbell bar, the connecting disc is provided with a positioning groove communicating with the inside and outside and a connecting block slidingly connected in the positioning groove, and the connecting disc is also provided with an elastic component for driving the connecting block to shrink inward;

The dumbbell assembly further comprises a handle grip and gear blocks which are rotatably sleeved on the dumbbell bar, and the handle grip and the gear block are fixed circumferentially, and the gear block has an outwardly pushing part and an inwardly shrinking part in the circumferential direction, the diameter of the outwardly pushing part is greater than the diameter of the inwardly shrinking part, and the distribution angles of the outwardly pushing part and the inwardly shrinking part on each of the gear block are different; the dumbbell piece is provided with a connecting groove, when an inner end of the connecting block abuts against the inwardly shrinking part, the connecting block is disengaged from the connecting groove; when the inner end of the connecting block abuts against the outwardly pushing part, the connecting block is snapped into the connecting groove; when the inner end of the connecting block abuts against the inwardly shrinking part, the connecting block is disengaged from the connecting groove.

Due to the different distribution angles of the outwardly pushing parts and inwardly shrinking parts on each gear block, when the handle glove is rotated to different angles relative to the dumbbell bar, different numbers of connecting blocks are pushed by the outwardly pushing parts and snapped in the connecting groove, so as to connect and snap the dumbbell pieces. Therefore, when the handle glove is rotated to different angles, different numbers of dumbbell pieces can be fixedly connected to realize the weight adjustment of the dumbbell according to the present application. The operation steps are few and the use is very convenient.

Further, the elastic component comprises escaping groove, a first elastic member and a retaining piece arranged on the connecting disc, the escaping groove is formed in the connecting block, the retaining piece extends into the escaping groove, and the first elastic member abuts between the inner side of the retaining piece and the inner wall of the escaping groove.

The elastic component can be used in conjunction with the gear block to realize the gear adjustment function of the present application. The elastic component only comprises the escaping groove, the first elastic member and the retaining piece, the structure is simple, and the use state is stable; The retaining piece is arranged in the escaping groove, and the sliding distance of the connecting block is limited, which prevents the connecting block from being out of working state, and also makes the connecting state of the connecting block more stable.

Further, the dumbbell is formed into a "U" shape, and two connecting grooves are arranged symmetrically on the inner side of a single dumbbell piece, and the number of the positioning groove and the connecting block on the single connecting disc is two, and the inwardly shrinking part and the outwardly pushing part are point-symmetrically distributed in the circumferential direction of the gear block.

There are two connection points between the connecting disc and the dumbbell piece and symmetrically arranged between the connecting block and the connecting groove, so that the force it bears is more uniform, balanced, and reduced, making the installation and connection of the dumbbell piece more secure. This makes the installation and connection of the dumbbell pieces more firm, makes the use safer, and also reduces the deformation or even breakage of the connection block due to uneven force, and increases the service life of the present application.

Further, the inner end of the connecting block is tapered, and a slope for transition is provided between the outwardly pushing part and the inwardly shrinking part, the shape of the slope is adapted to the shape of the inner end of the connecting block.

This makes it easier to switch and abut between the connecting block and the outwardly pushing part and the inwardly shrinking part, makes it easier for the user to turn the handle grip to switch the outwardly pushing part and the inwardly shrinking part on the gear block to abut the connecting block, makes it easier to switch the number of fixedly connected dumbbell pieces, which further facilitates the operation.

Further, the gear block is provided with a heteromorphy groove and a heteromorphy projection, the heteromorphy groove or the heteromorphy projection is also arranged on the handle grip, and the plurality of gear blocks and the handle grip are connected in series and circumferentially fixed by means of the heteromorphy groove and the heteromorphy projection.

The heteromorphy groove and the heteromorphy protrusion are used to realize the connection between the handle grip, the gear block and each gear block, the structure is simple, the processing difficulty and cost are reduced, and the installation is very simple. Dumbbells with different specifications can be made by installing different numbers of gear blocks on the dumbbell bars with different lengths, which saves the materials for making the gear blocks.

Further, the adjustable dumbbell comprises gear discs fixedly arranged with the handle grip in the circumferential direction and a fixed disc fixed with the connecting disc in the circumferential direction, the gear disc is provided with a plurality of gear holes, the fixed disc is provided with placement grooves and balls arranged in the placement groove, second elastic members abutting against the ball is arranged in the placement groove.

The gear holes are regularly distributed in the circumferential direction, and the user can know that the handle grip has been rotated by a specified angle by sensing the installation and connection of the ball and the gear hole, which is convenient for the user to quantify the rotation angle and facilitate the user's rotation operation.

Further, the fixed disc is provided with a downwardly extending locking groove and a locking block slidingly connected in the locking groove, a third elastic member is provided between the locking block and the locking groove, and a limiting notch is provided on the locking block, a plurality of locking pieces are arranged circumferentially on the edge of the gear disc, and safety projections are provide on the dumbbell seat; when the safety projection extends into the locking groove and abut against the locking block, the limiting notch is located on a moving path of the locking piece and can be passed by the locking piece; when the safety projection is disengaged from the locking groove, the limiting notch is staggered from the moving path of the locking piece, and the locking block is snapped in the gap between the two locking pieces.

The handle grip and the gear disc are fixed in the circumferential direction. When the dumbbell assembly is placed on the dumbbell seat, the safety protrusion extends into the locking groove so that the handle grip, the gear disc and each gear block can be rotated and the number of fixedly connected dumbbell pieces can be adjusted. When the dumbbell assembly is detached from the dumbbell seat, the safety projection is disengaged from the locking groove. The handle grip, gear disc and each gear block are locked with the dumbbell bar in the circumferential direction. Therefore, after the dumbbell assembly is detached from the dumbbell seat, the dumbbell pieces are prevented from being disconnected separately due to the rotation of the gear block, and the dumbbell pieces are prevented from falling and hurting the human body, making the use more stable and safe.

Further, the number of the ball, the placement groove and the second elastic member arranged on the fixed disc is two, and the gear holes are uniformly arranged on the circumference of the gear disc.

This makes the gear disc and the fixed disc have more connection points, and the force it bears is more uniform, which reduces the situation that the balls are deformed or deviate from the wording position due to uneven force, and makes the service life of the present application longer and makes the use state very stable.

Further, a housing is fixedly connected to the end of the dumbbell bar, and a fixed block is fixedly connected between the fixed disc and the housing, and the fixed block is snapped each of the connecting discs and fixed circumferentially.

A plurality of connecting discs is clamped simultaneously by the fixed block to realize circumferential fixing of the connecting discs and the dumbbell bar. The present application has a simple structure and is convenient for installation and production.

Compared with the prior art, the present application has the following beneficial effects:

1. Due to the different distribution angles of the outwardly pushing parts and inwardly shrinking parts on each gear block, when the handle grip is turned to a different angle relative to the dumbbell bar, different numbers of connecting blocks are pushed by the outwardly pushing parts and snapped into the connecting groove, so as to connect and snap the dumbbell pieces; Therefore, when the handle grip is rotated to different angles, different numbers of dumbbell pieces can be fixedly connected to realize the weight adjustment of the dumbbell according to the present application. The operation steps are few and the use is very convenient.

The elastic component can be used in conjunction with the gear block to realize the gear adjustment function of the present application. The elastic component only comprises the escaping groove, the first elastic member and the retaining piece, the structure is simple, and the use state is stable; The retaining piece is arranged in the escaping groove, and the sliding distance of the connecting block is limited, which prevents the connecting block from being out of working state, and also makes the connecting state of the connecting block more stable.

BRIEF DESCRIPTION OF DRAWINGS

In order to more clearly illustrate the technical solutions in the embodiments of the present application or the prior art, the following will briefly introduce the accompanying drawings that need to be used in the description of the embodiments or the prior art. Obviously, the drawings in the following description are only some embodiments of the present application. Apparently, the drawings in the following description are only some embodiments of the present application. For those skilled in the art, other drawings can also be obtained according to the structures shown in these drawings without any creative effort.

REFERENCE SIGNS

1. Dumbbell seat; 2. Dumbbell piece; 3. Dumbbell bar; 4. Connecting disc; 5. Positioning groove; 6. Connecting block; 7. Handle grip; 8. Gear block; 11. Connecting groove; 12. Escaping groove; 13. First elastic member; 14. Retaining piece; 15. Slope; 16. Heteromorphy groove; 17. Heteromorphy projection; 18. Gear disc; 20. Gear hole; 21. Placement groove; 22 Ball; 23. Second elastic member; 24. Locking groove; 25. Locking block; 26. Third elastic member; 27. limiting notch; 28. Locking piece; 29. Safety protrusion; 30. Housing; 31. Fixed block;

The realization, functional features and advantages of the present application will be further described in conjunction with the embodiments and with reference to the accompanying drawings.

DETAILED DESCRIPTION

The technical solution in the embodiment of the present application will be clearly and completely described below in conjunction with the accompanying drawings 1-7 in the embodiment of the present application. Obviously, the drawings in the following description are only some embodiments of the present application. Apparently, the drawings in the following description are only some embodiments of the present application. For those skilled in the art, other drawings can also be obtained according to the structures shown in these drawings without any creative effort.

It should be noted that all directional indications (such as up, down, left, right, front, back . . . ) in the embodiments of the present application are only used to explain the relationship between the components in a certain posture (as shown in the figure). Relative positional relationship, movement conditions, etc., if the specific posture changes, the directional indication will also change accordingly.

In addition, the descriptions involving "first", "second" and so on in the present application are only for the purpose of description, and should not be understood as indicating or implying their relative importance or implicitly specifying the quantity of the indicated technical features. Thus, the features defined as "first" and "second" may explicitly or implicitly include at least one of these features. In addition, the technical solutions of the various embodiments can be combined with each other, but it must be based on the realization of those skilled in the art. When the combination of technical solutions is contradictory or cannot be realized, it should be considered that the combination of technical solutions does not exist, nor within the scope of protection required by the present application.

Figure 1:
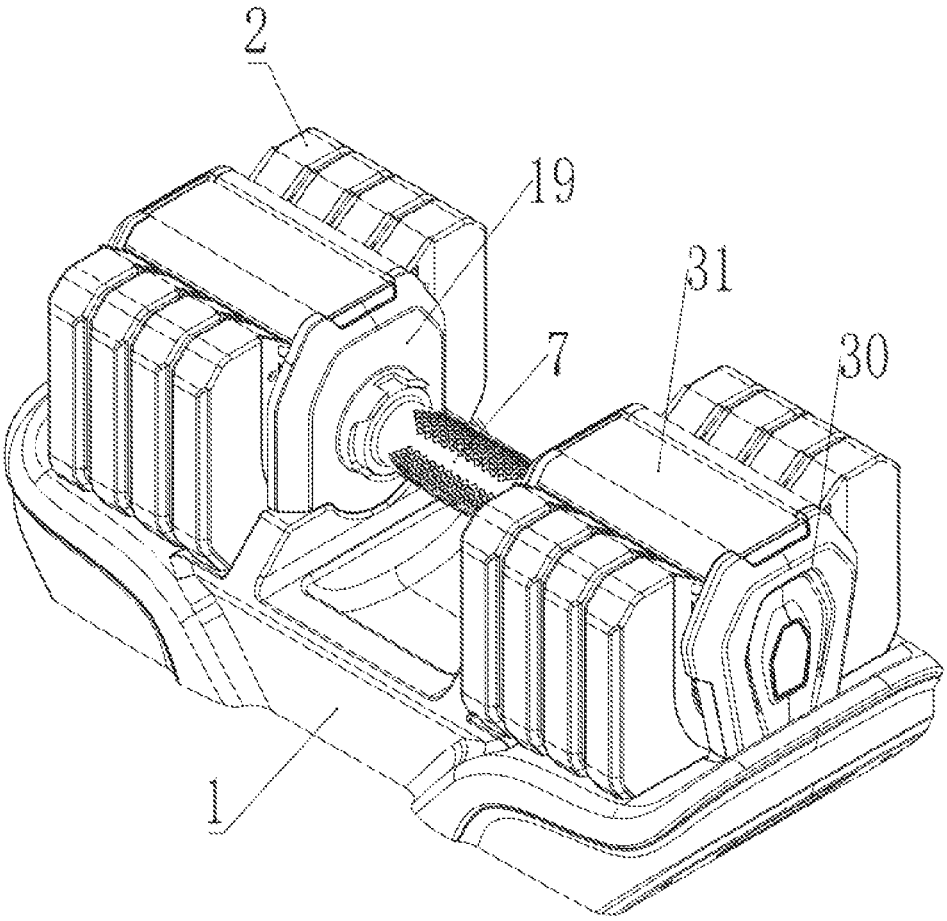
FIG. 1 is a schematic structural diagram of the present application.
Figure 2:
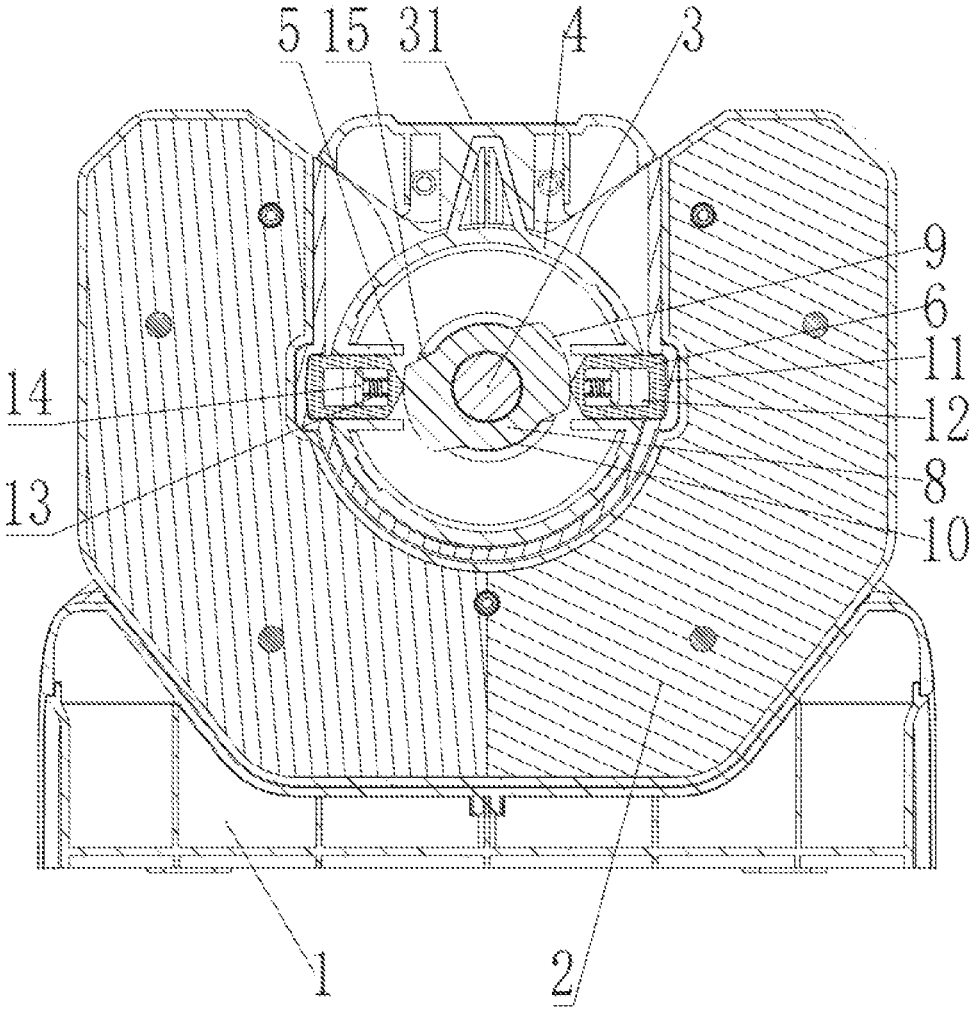
FIG. 2 is a first schematic diagrams of the internal structure of the present application.
Figure 3:
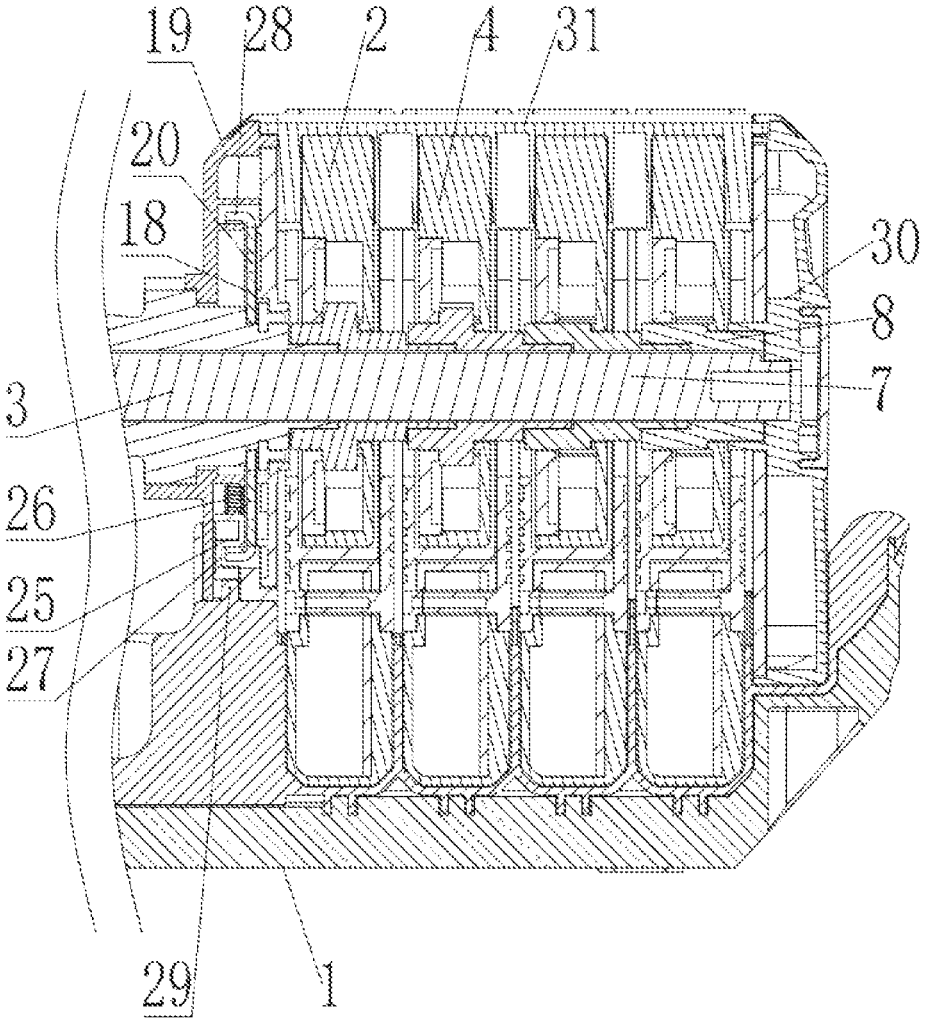
FIG. 3 is a second schematic diagram of the internal structure of the present application.
Figure 5:
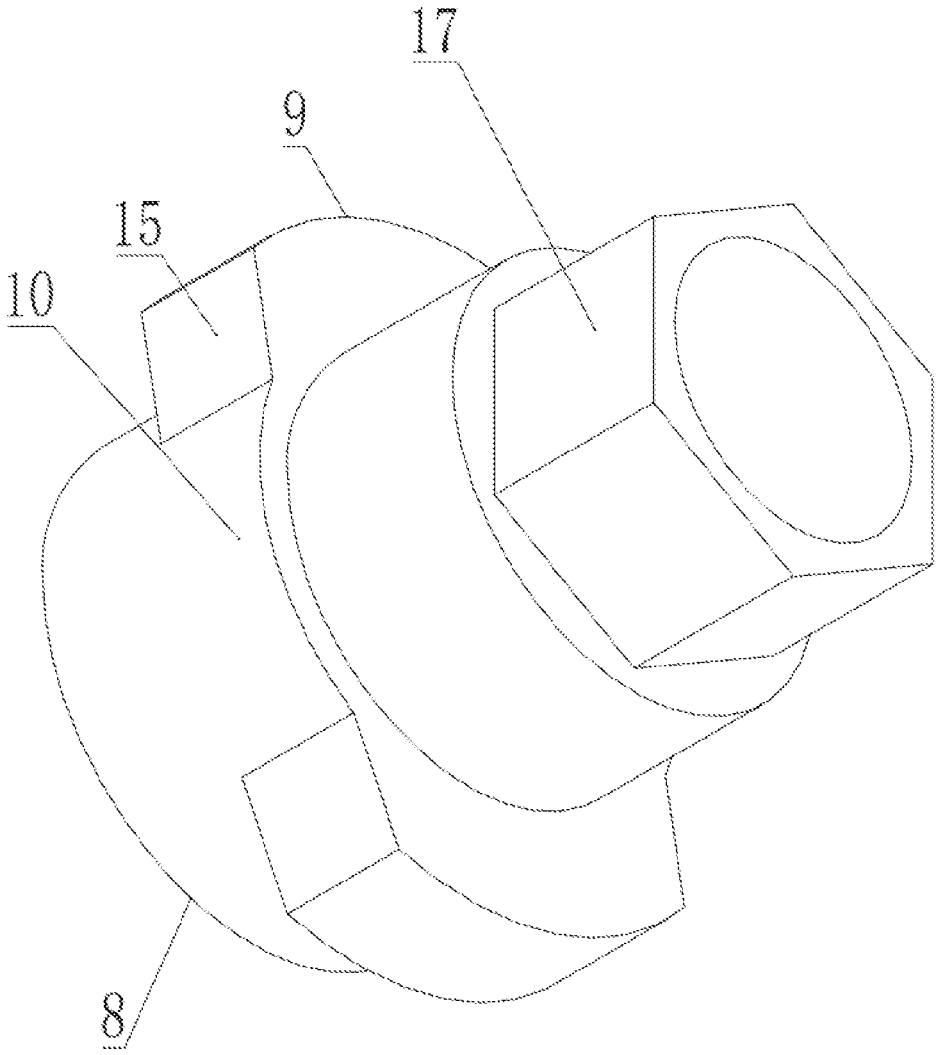
FIG. 5 is a schematic diagram of the gear block of the present application.
Figure 6:
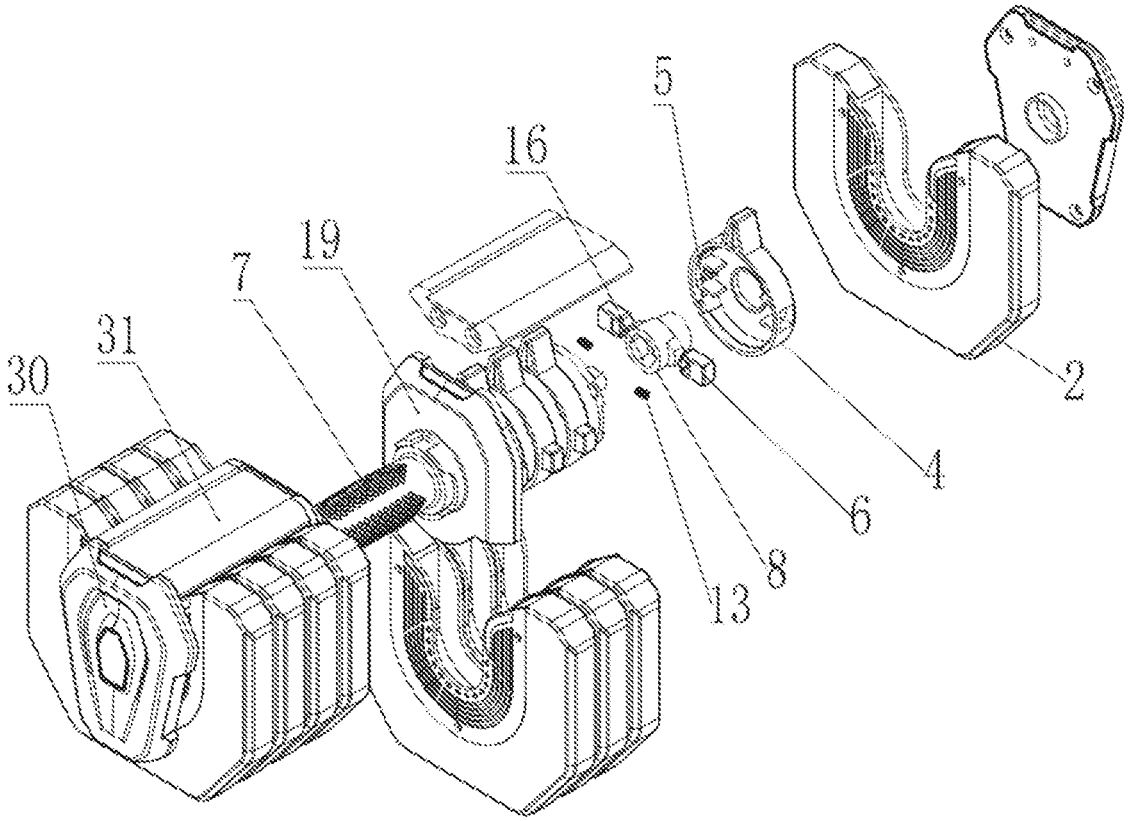
FIG. 6 is a first schematic explosion diagram of the present application.

As shown in FIGS. 1, 2, 3, 5, and 6: an adjustable dumbbell, comprising a dumbbell assembly, a dumbbell seat 1 and a plurality of dumbbell pieces 2 for placing on the dumbbell seat 1, wherein the dumbbell assembly comprises a dumbbell bar 3 and a plurality of connecting discs 4 circumferentially fixed with the dumbbell bar 3, the connecting disc 4 is provided with a positioning groove 5 communicating with the inside and outside and a connecting block 6 slidingly connected in the positioning groove 5, and the connecting disc 4 is also provided with an elastic component for driving the connecting block 6 to shrink inward; the dumbbell assembly further comprises a handle grip 7 and gear blocks 8 which are rotatably sleeved on the dumbbell bar 3, and the handle grip 7 and the gear block 8 are fixed circumferentially, and the gear block 8 has an outwardly pushing part 9 and an inwardly shrinking part 10 in the circumferential direction, the diameter of the outwardly pushing part 9 is greater than the diameter of the inwardly shrinking part 10, and the distribution angles of the outwardly pushing part 9 and the inwardly shrinking part 10 on each of the gear block 8 are different; the dumbbell piece 2 is provided with a connecting groove 11, when an inner end of the connecting block 6 abuts against the inwardly shrinking part 10, the connecting block 6 is disengaged from the connecting groove 11; when the inner end of the connecting block 6 abuts against the outwardly pushing part 9, the connecting block 6 is snapped into the connecting groove 11; when the inner end of the connecting block 6 abuts against the inwardly shrinking part 10, the connecting block 6 is disengaged from the connecting groove 11. Due to the different distribution angles of the outwardly pushing parts 9 and inwardly shrinking parts 10 on each gear block 8, when the handle glove 7 is rotated to different angles relative to the dumbbell bar 3, different numbers of connecting blocks 6 are pushed by the outwardly pushing parts 9 and snapped in the connecting groove 11, so as to connect and snap the dumbbell pieces 2. Therefore, when the handle glove 7 is rotated to different angles, different numbers of dumbbell pieces 2 can be fixedly connected to realize the weight adjustment of the dumbbell according to the present application. The operation steps are few and the use is very convenient.

In the present application, preferably, four dumbbell plates 2 are respectively arranged on both sides of the dumbbell bar 3. In this application, when the handle grip 7 is preferably rotated to different angles, five different use effects will be produced, which are divided into "gear position one", "gear position two", "gear position three", "gear position four", and "gear position five".

When each gear block 8 is rotated to "gear position one", a dumbbell piece 2 is fixedly connected to both sides of the dumbbell bar 3 through the connecting groove 11 and the connecting block 6;

When each gear block 8 is rotated to "gear position two", two dumbbell pieces 2 are fixedly connected to both sides of the dumbbell bar 3 through the connecting groove 11 and the connecting block 6;

When each gear block 8 is rotated to "gear position three", three dumbbell pieces 2 are fixedly connected to both sides of the dumbbell bar 3 through the connecting groove 11 and the connecting block 6;

When each gear block 8 is rotated to "gear position four", four dumbbell pieces 2 are fixedly connected to both sides of the dumbbell bar 3 through the connecting groove 11 and the connecting block 6;

When each gear block 8 is rotated to "gear position five", both sides of the dumbbell bar 3 will not be connected to the dumbbell piece 2.

Preferably, the rotation angles between the various gears are uniformly distributed in the circumferential direction.

The present application further comprises gear discs 18 fixedly arranged with the handle grip 7 in the circumferential direction and a fixed disc 19 fixed with the connecting disc 4 in the circumferential direction, the gear disc 18 is provided with a plurality of gear holes 20, the fixed disc 19 is provided with placement grooves 21 and balls 22 arranged in the placement groove 21, second elastic members 23 abutting against the ball 22 is arranged in the placement groove 21. The gear holes 20 are regularly distributed in the circumferential direction, and the user can know that the handle grip 7 has been rotated by a specified angle by sensing the installation and connection of the ball 22 and the gear hole 21, which is convenient for the user to quantify the rotation angle and facilitate the user's rotation operation. In order to cooperate with the realization of the five gears, there are ten gear holes 20 in the circumferential direction, and in the present application, two balls 22 are preferably arranged vertically and symmetrically on the fixed disc 19. The number of the ball 22, the placement groove 21 and the second elastic member 23 arranged on the fixed disc 19 is two, and the gear holes 20 are uniformly arranged on the circumference of the gear disc 18. This makes the gear disc 18 and the fixed disc 19 have more connection points, and the force it bears is more uniform, which reduces the situation that the balls 22 are deformed or deviate from the wording position due to uneven force, and makes the service life of the present application longer and makes the use state very stable.

The elastic component comprises escaping groove 12, a first elastic member 13 and a retaining piece 14 arranged on the connecting disc 4, the escaping groove 12 is formed in the connecting block 6, the retaining piece 14 extends into the escaping groove 12, and the first elastic member 13 abuts between the inner side of the retaining piece 14 and the inner wall of the escaping groove 12. The elastic component can be used in conjunction with the gear block 8 to realize the gear adjustment function of the present application. The elastic component only comprises the escaping groove 12, the first elastic member 13 and the retaining piece 14, the structure is simple, and the use state is stable; The retaining piece 14 is arranged in the escaping groove 12, and the sliding distance of the connecting block 6 is limited, which prevents the connecting block 6 from being out of working state, and also makes the connecting state of the connecting block 6 more stable.

The dumbbell 2 is formed into a "U" shape, and two connecting grooves 11 are arranged symmetrically on the inner side of a single dumbbell piece, and the number of the positioning groove 5 and the connecting block 6 on the single connecting disc 4 is two, and the inwardly shrinking part 10 and the outwardly pushing part 9 are point-symmetrically distributed in the circumferential direction of the gear block 8. There are two connection points between the connecting disc 4 and the dumbbell piece 2 and symmetrically arranged between the connecting block 6 and the connecting groove 11, so that the force it bears is more uniform, balanced, and reduced, making the installation and connection of the dumbbell piece 2 more secure. This makes the use safer, and also reduces the deformation or even breakage of the connection block 6 due to uneven force, and increases the service life of the present application.

The inner end of the connecting block 6 is tapered, and a slope 15 for transition is provided between the outwardly pushing part 9 and the inwardly shrinking part 10, the shape of the slope 15 is adapted to the shape of the inner end of the connecting block 6. This makes it easier to switch and abut between the connecting block 6 and the outwardly pushing part 9 and the inwardly shrinking part 10, makes it easier for the user to turn the handle grip 7 to switch the outwardly pushing part 9 and the inwardly shrinking part 10 on the gear block 8 to abut the connecting block 6, makes it easier to switch the number of fixedly connected dumbbell pieces 2, which further facilitates the operation. In order to realize the five kinds of gear states, it is preferable that four kinds of gear blocks 8 are arranged on both sides of the dumbbell bar 3, and the angles occupied by the inwardly shrinking part 10 arranged on each gear block 8 in the circumferential direction are respectively 0 degree and 36 degrees, 72 degrees and 108 degrees.

The gear block 8 is provided with a heteromorphy groove 16 and a heteromorphy projection 17, the heteromorphy groove 16 or the heteromorphy projection 17 is also arranged on the handle grip 7, and the plurality of gear blocks 8 and the handle grip 7 are connected in series and circumferentially fixed by means of the heteromorphy groove 16 and the heteromorphy projection 17. The heteromorphy groove 16 and the heteromorphy protrusion 17 are used to realize the connection between the handle grip 7, the gear block 8 and each gear block 8, the structure is simple, the processing difficulty and cost are reduced, and the installation is very simple. Dumbbells with different specifications can be made by installing different numbers of gear blocks 8 on the dumbbell bars 3 with different lengths, which saves the materials for making the gear blocks 8. When the shapes of the heteromorphy groove 16 and the heteromorphy projection 17 were regular polygons, the force between the heteromorphy groove 16 and the heteromorphy projection 17 was uniform, which reduced the situation of deformation and wear. Preferably, the heteromorphy groove 16 and the heteromorphy protrusion 17 are regular hexagons with matching sizes.

Figure 4:
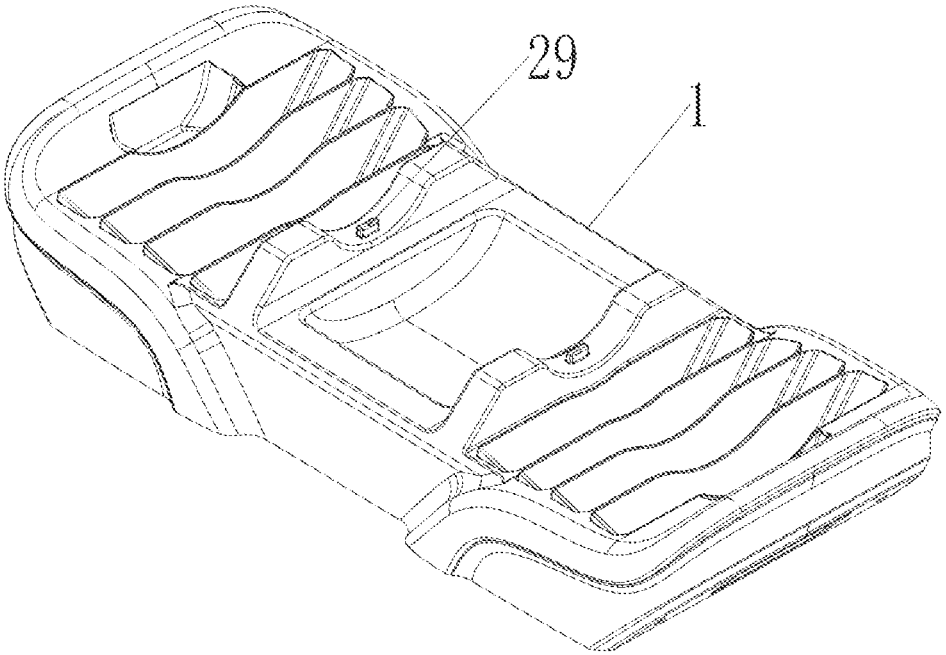
FIG. 4 is a schematic diagram of the dumbbell seat of the present application.
Figure 7:
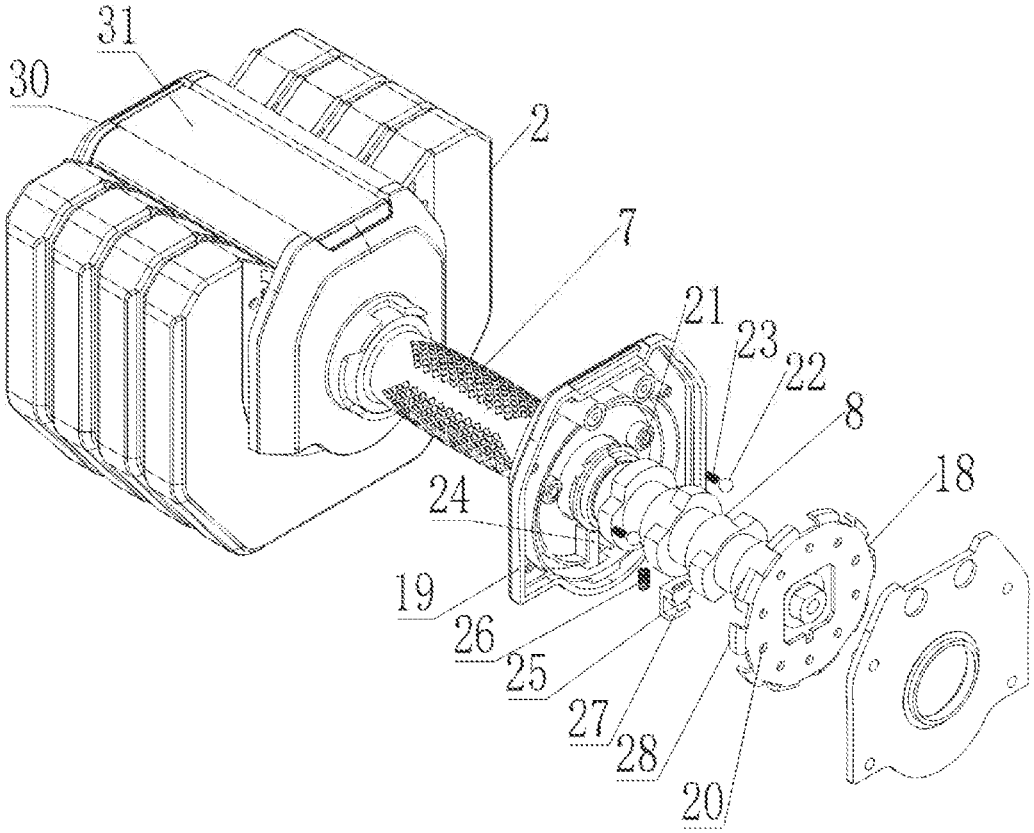
FIG. 7 is a second schematic explosion diagram of the present application.

As shown in FIGS. 1, 3, 4, and 7: the fixed disc 19 is provided with a downwardly extending locking groove 24 and a locking block 25 slidingly connected in the locking groove 24, a third elastic member 26 is provided between the locking block 25 and the locking groove 24, and a limiting notch 27 is provided on the locking block 25, a plurality of locking pieces 28 are arranged circumferentially on the edge of the gear disc 18, and safety projections 29 are provide on the dumbbell seat 1; when the safety projection 29 extends into the locking groove 24 and abut against the locking block 25, the limiting notch 27 is located on a moving path of the locking piece 28 and can be passed by the locking piece 28; when the safety projection 29 is disengaged from the locking groove 24, the limiting notch 27 is staggered from the moving path of the locking piece 28, and the locking block 25 is snapped in the gap between the two locking pieces 28. The handle grip 7 and the gear disc 18 are fixed in the circumferential direction. When the dumbbell assembly is placed on the dumbbell seat 1, the safety protrusion 29 extends into the locking groove 24 so that the handle grip 7, the gear disc 18 and each gear block 8 can be rotated and the number of fixedly connected dumbbell pieces 2 can be adjusted. When the dumbbell assembly is detached from the dumbbell seat 1, the safety projection 29 is disengaged from the locking groove 24. The handle grip 7, gear disc 18 and each gear block 8 are locked with the dumbbell bar 3 in the circumferential direction. Therefore, after the dumbbell assembly is detached from the dumbbell seat 1, the dumbbell pieces 2 are prevented from being disconnected separately due to the rotation of the gear block 8, and the dumbbell pieces 2 are prevented from falling and hurting the human body, making the use more stable and safe.

A housing 30 is fixedly connected to the end of the dumbbell bar 3, and a fixed block 31 is fixedly connected between the fixed disc 19 and the housing 30, and the fixed block 31 is snapped each of the connecting discs 4 and fixed circumferentially. A plurality of connecting discs 4 is clamped simultaneously by the fixed block 31 to realize circumferential fixing of the connecting discs 4 and the dumbbell bar 3. It has a simple structure and is convenient for installation and production.

Preferably, the first elastic member 13, the second elastic member 23 and the third elastic member 26 are all springs.

The above is only a preferred embodiment of the present application, and is not intended to limit the patent scope of the present application. Under the application concept of the present application, any equivalent structural transformation made by using the contents of this application specification and drawings, or directly/indirectly used in other related technical fields are included in the scope of patent protection of this application.

What is claimed is:

1. An adjustable dumbbell, comprising a dumbbell assembly, a dumbbell seat and a plurality of dumbbell pieces for placing on the dumbbell seat, wherein the dumbbell assembly comprises a dumbbell bar and a plurality of connecting discs circumferentially fixed with the dumbbell bar, each of the connecting disc is provided with a positioning groove communicating with the inside and outside of the connecting discs, and a connecting block slidingly connected in the positioning groove, and each of the connecting disc is also provided with an elastic component for driving the connecting block to shrink inward;

the dumbbell assembly further comprises a handle grip and a plurality of gear blocks which are rotatably sleeved on the dumbbell bar, and the handle grip and each of the gear block are fixed circumferentially, and each of the gear block has an outwardly pushing part and an inwardly shrinking part in a circumferential direction, a diameter of the outwardly pushing part is greater than a diameter of the inwardly shrinking part, and distribution angles of the outwardly pushing part and the inwardly shrinking part on each of the gear block are different; each of the dumbbell piece is provided with a connecting groove, when an inner end of the connecting block abuts against the inwardly shrinking part, the connecting block is disengaged from the connecting groove; when the inner end of the connecting block abuts against the outwardly pushing part, the connecting block is snapped into the connecting groove; when the inner end of the connecting block abuts against the inwardly shrinking part, the connecting block is disengaged from the connecting groove.

2. The adjustable dumbbell according to claim 1, wherein the elastic component comprises an escaping groove, a first elastic member and a retaining piece arranged on the connecting discs, the escaping groove is formed in the connecting block, the retaining piece extends into the escaping groove, and the first elastic member abuts between an inner side of the retaining piece and an inner wall of the escaping groove.

3. The adjustable dumbbell according to claim 1, wherein each of the dumbbell piece is formed into a "U" shape, and two connecting grooves are arranged symmetrically on an inner side of a single dumbbell piece, and the number of the positioning groove and the connecting block on each of the connecting disc is two, and the inwardly shrinking part and the outwardly pushing part are point-symmetrically distributed in the circumferential direction of each of the gear block.

4. The adjustable dumbbell according to claim 3, wherein the inner end of the connecting block is tapered, and a slope for transition is provided between the outwardly pushing part and the inwardly shrinking part, the shape of the slope is adapted to the shape of the inner end of the connecting block.

5. The adjustable dumbbell according to claim 4, wherein each of the gear block is provided with a heteromorphic groove and a heteromorphic projection, the heteromorphic groove or the heteromorphic projection is also arranged on the handle grip, and the plurality of gear blocks and the handle grip are connected in series and circumferentially fixed by means of the heteromorphic groove and the heteromorphic projection.

6. The adjustable dumbbell according to claim 1, further comprising gear discs fixedly arranged with the handle grip in the circumferential direction and a fixed disc fixed with the connecting discs in the circumferential direction, each of the gear disc is provided with a plurality of gear holes, the fixed disc is provided with placement grooves and balls arranged in the placement grooves, second clastic members abutting against the balls is are arranged in the placement grooves.

7. The adjustable dumbbell according to claim 6, wherein the fixed disc is provided with a downwardly extending locking groove and a locking block slidingly connected in the locking groove, a third elastic member is provided between the locking block and the locking groove, and a limiting notch is provided on the locking block, a plurality of locking pieces are arranged circumferentially on an edge of each of the gear disc, and safety projections are provide on the dumbbell seat; when each of the safety projection extends into the locking groove and abuts against the locking block, the limiting notch is located on a moving path of each of the locking piece and is passed by each of the locking piece; when each of the safety projection is disengaged from the locking groove, the limiting notch is staggered from the moving path of each of the locking piece, and the locking block is snapped in a gap between two of the locking pieces.

8. The adjustable dumbbell according to claim 7, wherein the number of the balls, the placement grooves and the second elastic members arranged on the fixed disc is two, and the gear holes are uniformly arranged on the circumference of each of the gear disc.

9. The adjustable dumbbell according to claim 7, wherein a housing is fixedly connected to an end of the dumbbell bar, and a fixed block is fixedly connected between the fixed disc and the housing, and the fixed block is snapped each of the connecting disc and fixed circumferentially.

* * * * *